United States Patent [19]

Tomassetti, Jr. et al.

[11] 3,999,337

[45] Dec. 28, 1976

[54] DOME STRUCTURES

[76] Inventors: Jerome Tomassetti, Jr., Box 288 R.D. No. 1, Canonsburg, Pa. 15317; Adolph F. Lerch, Lynwood Drive, Valencia, Pa. 16059

[22] Filed: Jan. 30, 1975

[21] Appl. No.: 545,389

Related U.S. Application Data

[63] Continuation-in-part of Ser. No. 240,635, April 3, 1972, abandoned.

[52] U.S. Cl. ..... 52/82; 98/41 AV; 52/309.14

[51] Int. Cl.[2] ..... E04B 7/00

[58] Field of Search ..... 52/80, 82, 237, 122; 98/41 A

[56] References Cited

UNITED STATES PATENTS

| | | | |
|---|---|---|---|
| 248,601 | 10/1881 | Mihan | 98/41 A |
| 942,884 | 12/1909 | Buckwalter | 52/82 |
| 1,019,334 | 3/1912 | McClure | 52/82 |
| 1,258,410 | 3/1918 | Hill | 52/82 |
| 2,356,768 | 8/1944 | Ladon | 52/82 |
| 2,820,990 | 1/1958 | Johnson | 52/82 |
| 3,255,560 | 6/1966 | McClenahan | 52/237 |
| 3,389,202 | 6/1968 | Waling | 52/80 |
| 3,452,493 | 7/1969 | Mims | 52/237 |
| 3,543,454 | 12/1970 | Danin | 52/80 |
| 3,562,975 | 2/1971 | Moss | 52/79 |
| 3,633,325 | 1/1972 | Bartoli | 52/237 |
| 3,763,608 | 10/1973 | Chamlee | 52/302 |

FOREIGN PATENTS OR APPLICATIONS

| | | | |
|---|---|---|---|
| 577,240 | 6/1959 | Canada | 52/82 |

*Primary Examiner*—John E. Murtagh
*Attorney, Agent, or Firm*—Buell, Blenko & Ziesenheim

[57] ABSTRACT

A dome structure having a stabilizer pole forming the apex of the dome. A plurality of spaced riser beams are arched and terminate at the apex and join a plurality of arched panel members. Each of the panel members taper from a wide base to a narrow top at the apex.

5 Claims, 14 Drawing Figures

Fig. 9.
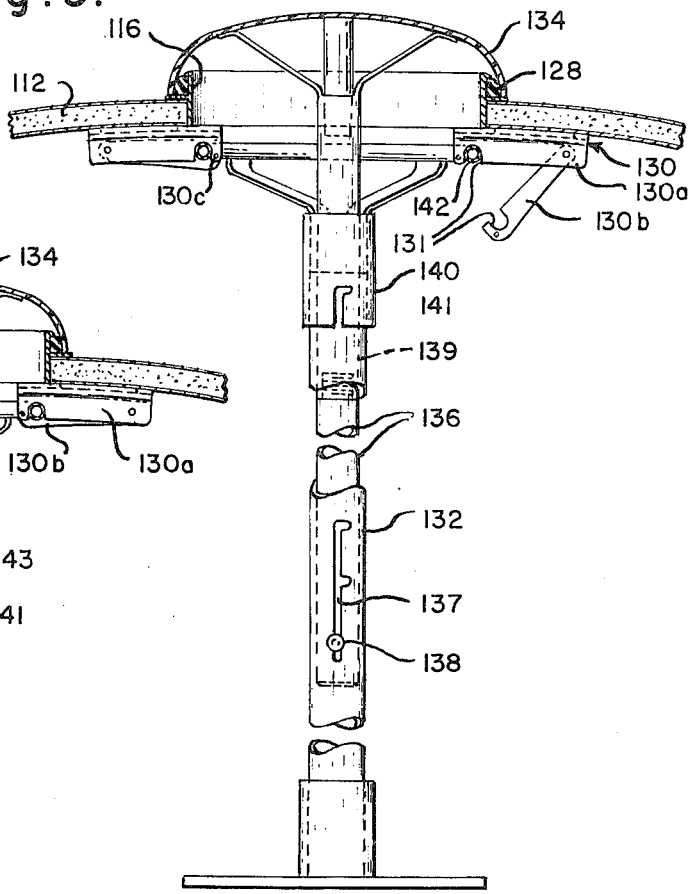
Fig. 13.
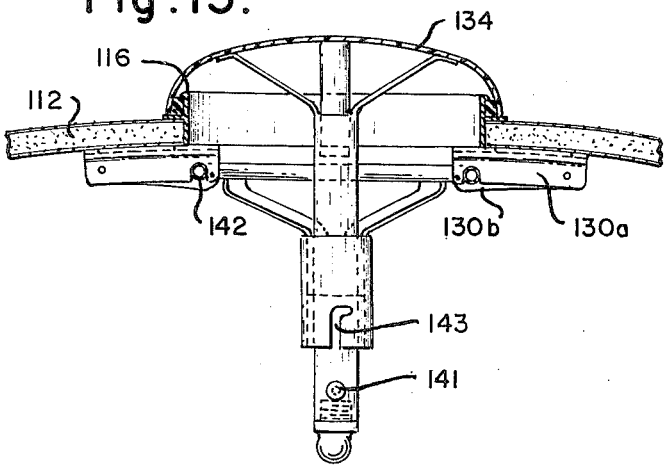
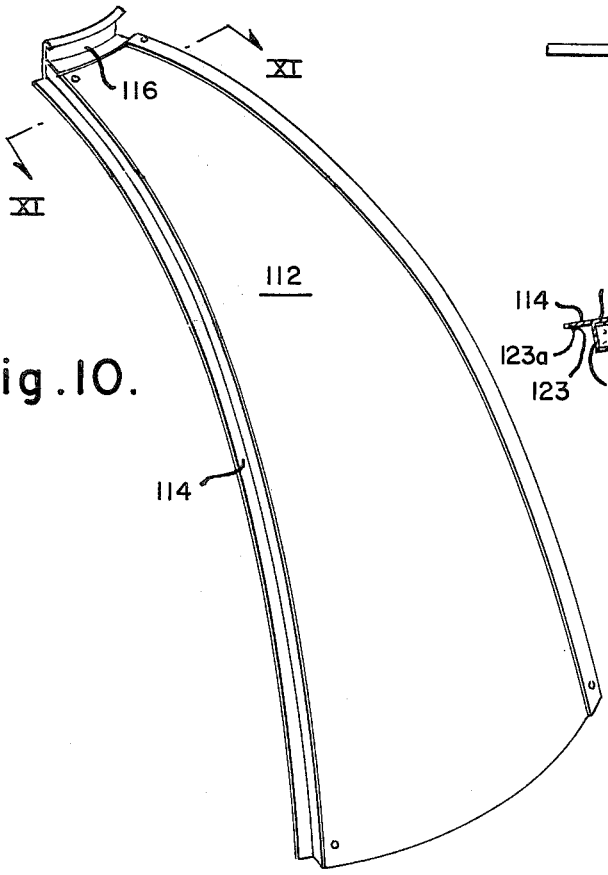
Fig. 10.
Fig. 11.
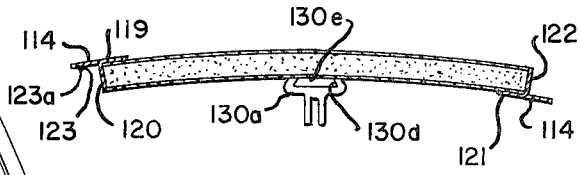

DOME STRUCTURES

This application is a continuation-in-part of our copending application Ser. No. 240,635, filed Apr. 3, 1972, now abandoned.

The invention relates to dome structures and in particular to dome structures which may be quickly assembled and disassembled, with stabilizer poles for erecting and stabilizing the dome structure.

Prior art dome structures are complex and lack stability. They are generally difficult to assemble and expensive. The instant invention by the applicants provides a simplified dome structure utilizing an erection stabilizer column to provide additional stability to facilitate erection.

Characteristic of prior art dome structures are those set out in Moss, U.S. Pat. No. 3,562,975; Danin, U.S. Pat. No. 3,543,454; McClure, U.S. Pat. No. 1,019,334; Johnson, U.S. Pat. No. 2,820,990; Waling, U.S. Pat. No. 3,389,202; and Canadian patent 577,240 to Janousky. These patents provide structures which require bending of the elements in place (Moss and Johnson) fixed center props (McClure and the Canadian patent) coupled with the necessity of fixed anchoring systems. Such systems are impractical if not inoperative in most situations where dome structures would be desirable.

The structures of this invention are quickly assembled and disassembled. They may be quickly arranged to provide a variety of interior arrangements and they may be assembled as a plurality of units.

Preferably we provide a domed structure which comprises a removable stabilizer pole, a stabilizer ring removably mounted on the top of the stabilizer pole, a plurality of pairs of arched riser beams connected at one end to the top of the stabilizer pole, and a number of panel members preferably of preformed compound curved arched shape and of generally triangular shape and equal to the number of pairs of riser beams, each panel being fixed between a pair of riser beams. Preferably the other end of the riser beams is attached to a footer or base defining the area being covered by the dome. The riser beams are preferably provided at the said other end with hinge members, one half fixed to the riser and the other free for attachment to a base or for casting into a concrete footer or the like. Each of the arched panel members preferably has a hook means fixed to the apex of the triangle and adapted removably to engage the stabilizer ring surrounding and fixed to the top of the stabilizer pole. Preferably the arched panel members form, at their apex or top end, a circular opening having a vertically movable dome mounted on the stabilizer ring and movable vertically to open and close the circular opening to provide ventilation. Movable partition means may be removably and rotatably attached to the removable stabilizer pole. In a preferred embodiment the riser beams are integral with the panel members.

In the foregoing general description we have set out certain objects, purposes and advantages of our invention. Other objects, purposes and advantages of this invention will be apparent from a consideration of the following description and the accompanying drawings in which:

FIG. 9 is a detailed fragmentary view of a second and preferred embodiment of stabilizer pole of FIG. 1 in elevation;

FIG. 10 is a detailed fragmentary view of a second and preferred arched panel member according to this invention;

FIG. 11 is a fragmentary section of an integral riser beam and panel structure according to this invention;

FIG. 13 is a section through a second embodiment of dome structure incorporating the stabilizer pole of FIG. 9 with the stabilizer pole removed.

Figure 1:
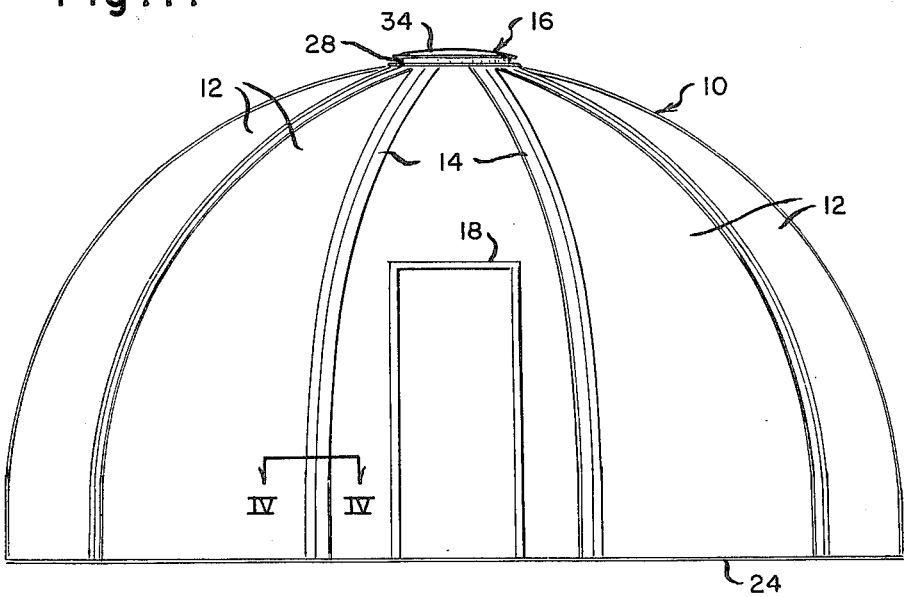
FIG. 1 is a side elevation of a dome structure according to this invention.

Referring to the drawings, FIG. 1 shows a dome structure 10 with a plurality of arched panel members 12. Connecting each of the panel members 12 are arched riser beams 14. The arched panel members 12 and the arched riser beams 14 terminate at an apex generally designated as 16. The arched panel members 12 taper in generally triangular form from a wide base to a narrow top at the apex 16. Within one of the panel members 12 is a door frame 18.

Figure 4:
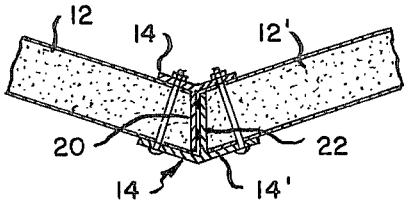
FIG. 4 is an enlarged fragmentary view of the joint taken on the line IV—IV of FIG. 1.

FIG. 4 shows an enlarged view taken on the line IV—IV of FIG. 1, showing a pair of rigid arched panel members 12 and 12' joined with a riser 14 comprised of two formed sections 14 and 14'. The formed sections of the arched riser will be described as of T form, however they may be of Y shape, ↑ shape or similar suitable shape. Each of the T members has a top portion and center portions 20 and 22. The edge of the panel members 12 and 12' are inserted to abut the center portions 20 and 22 by bolting or by some other suitable method of fastening. The two center portions 20 and 22 of the T's 14 and 14' abut each other and an H section is formed which couples the two adjacent panels 12 and 12' together.

Figure 2:
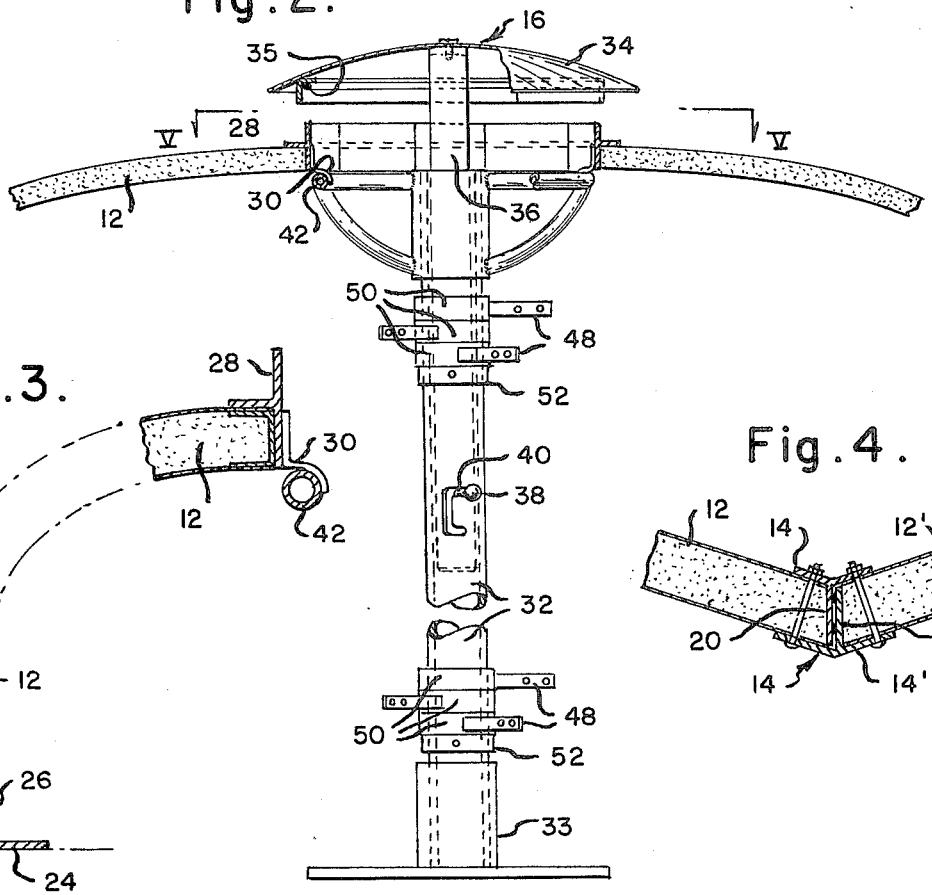
FIG. 2 is a detailed fragmentary view of the stabilizer pole of FIG. 1 in elevation.
Figure 3:
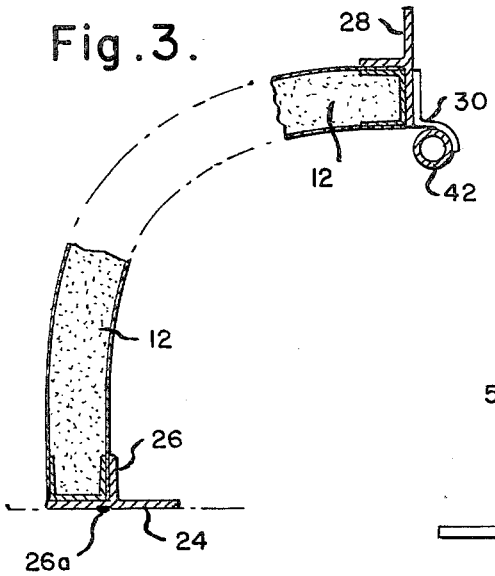
FIG. 3 is a detailed fragmentary view of an arched panel member in elevation.
Figure 5:
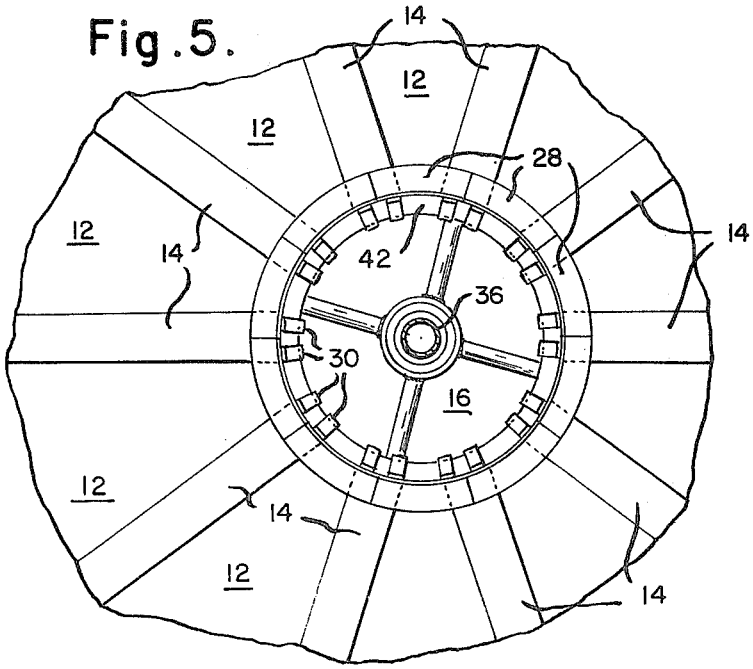
FIG. 5 is a top fragmentary view of the riser and panel member attached to the horizontal ring on the stabilizer pole.
Figure 7:
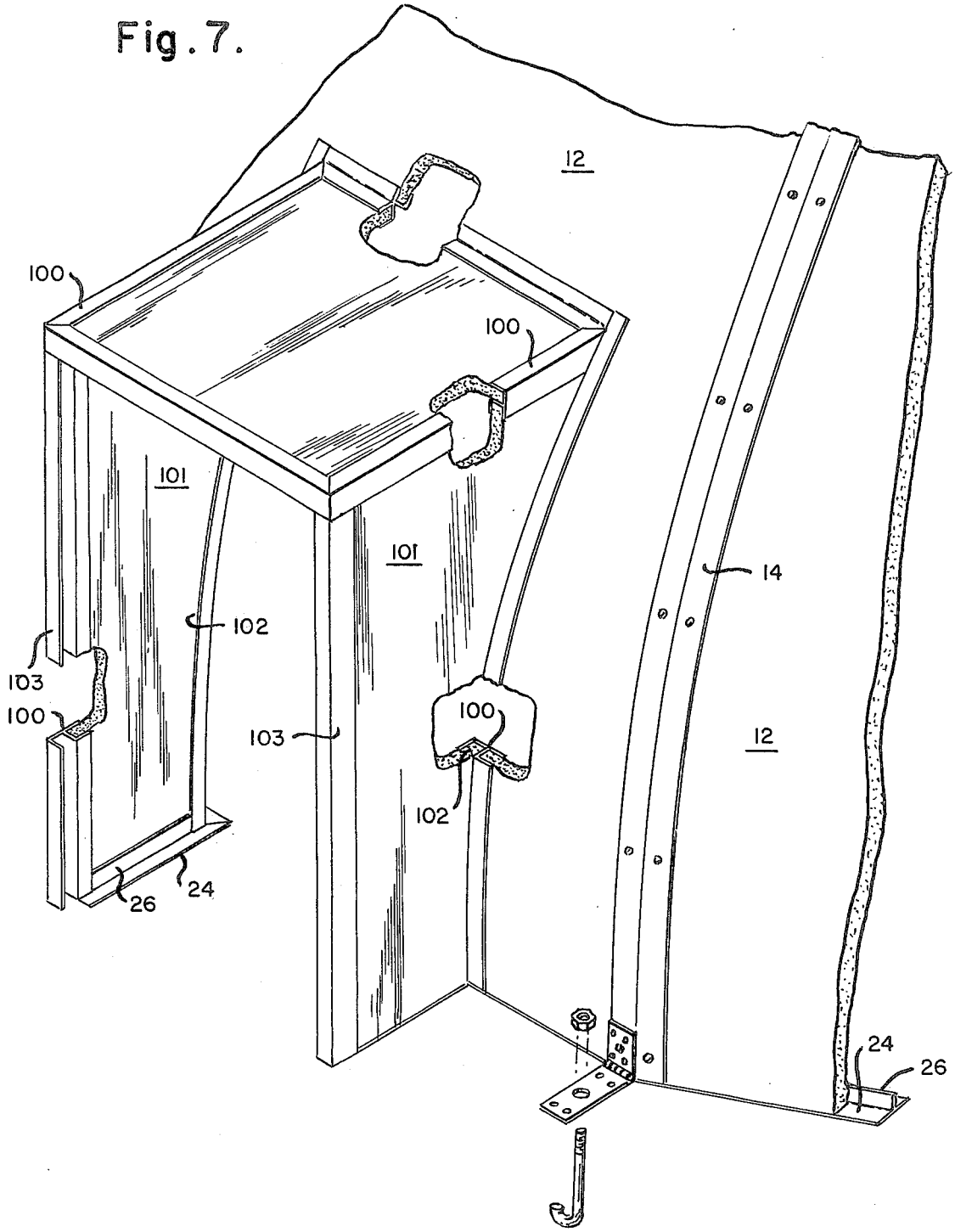
FIG. 7 is an enlarged isometric view of a wall member with entry structure.

Referring to FIG. 3, the arched panel member 12 on its base end is coupled to a T member 24 having a center portion of the T 26. The edge of panel member 12 is bolted to the inside of the top of the T member 24 and one face of the panel 12 abuts the center portion 26 of the T member 24. Preferably the opposite side of the center portion or web of the T is provided with a sealing or weather strip of resilient material such as rubber or neoprene 26*a*. At the upper end of the panel member 12 which terminates at the apex 16, another T member 28 is affixed with a hook member 30. The panel 12 is preferably formed of a resin foam such as urethane foam sandwiched between a solid sheet skin, e.g. aluminum, steel, plastic, on both sides. However, any other suitable material may be used. For example clear acrylic panels could be used to provide a green house or like structure. Inside the dome section, shown in FIG. 1, is a stabilizer pole, generally designated 32 as shown in FIG. 2. The top of the pole 32 has a ventilator cap 34 which forms the apex 16. The stabilizer pole 32 has a shaft 36 with an activator rod 38 inside and coupled to the ventilator cap 34. The shaft 36 has an opening slit with a handle 40 for moving the activator rod 38 up and down, thereby lifting the ventilator cap 34 up or down off its seat formed by a plurality of T sections 28. A neoprene ring 35 seals the ventilator cap 34 with the T sections when it is closed. At the top of the stabilizer pole 32 is a horizontal ring 42 over which hooks 30 engage and hold the panels 12 and the risers 14 to the apex area 16. This is also shown in FIG. 5 which is a top fragmentary view of the risers 14 and the arched panel 12 with hooks 30 coupled through T section 28. A stabilizer base and plate 33 holds the stabilizer pole 32.

Figure 6:
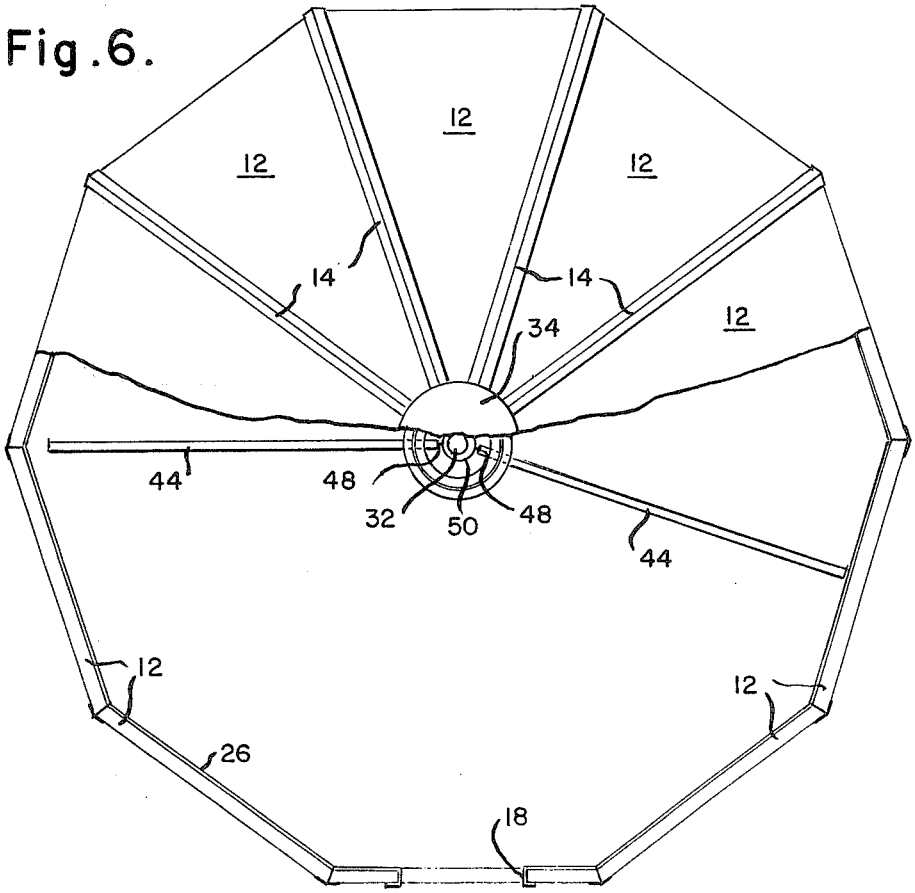
FIG. 6 is a top plan view of the dome structure partly cut away to show the partition.

FIG. 6 shows a top view of a plurality of wall dividers 44 which are movable and are supported by hinges 48 on rings 50 and 52 surrounding the stabilizer pole 32. To assist in moving the wall panel dividers 44, casters, not shown, are placed on one end.

Figure 8:
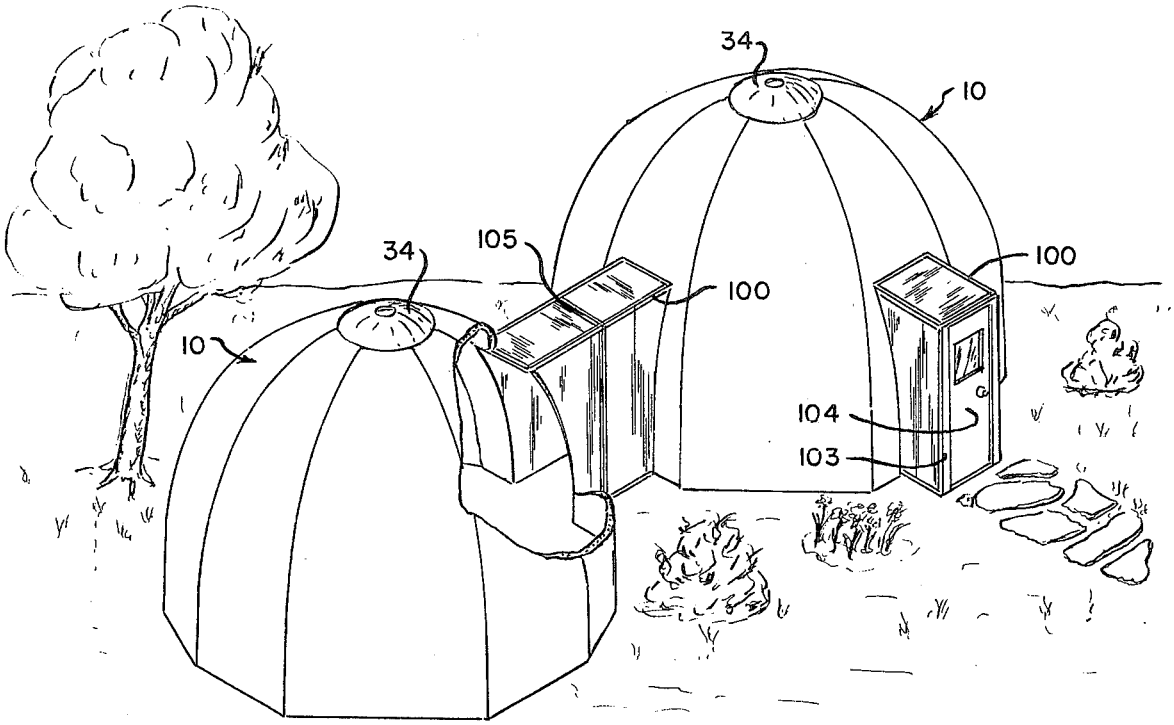
FIG. 8 is an isometric view of a plurality of interconnected domes.
Figure 14:
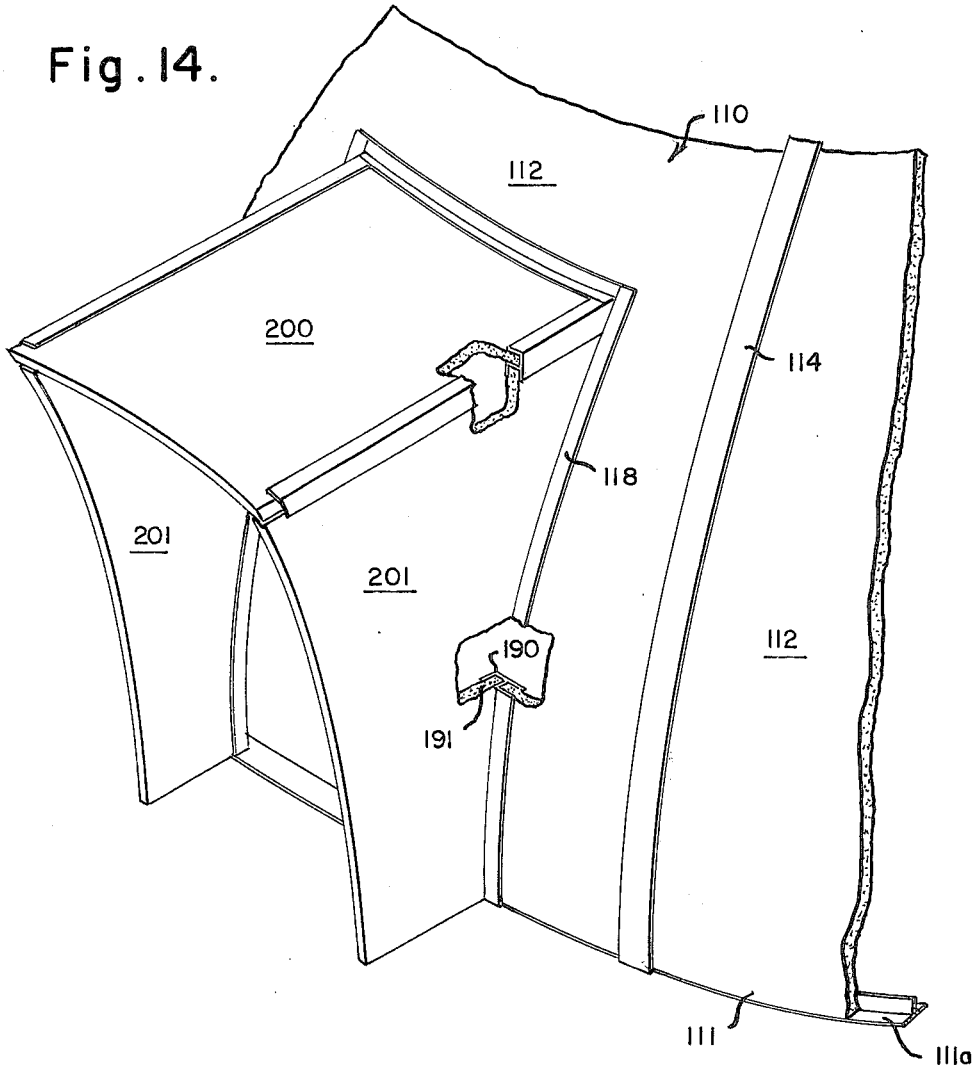
FIG. 14 is an enlarged isometric view of a second and preferred form of entry structure according to this invention.

Door and window openings may be formed in selected panels by using Y shaped panel holders 90 and filler panels 91 having an arcuate edge 92 corresponding in curvature to the curvature of the panel. A door or window frame 93 is held to the filler panel 91 by holders 90 and the door 94 hinged thereto or in the case of a window, the window is fastened by any of the known conventional means.

Where it is desired to connect several dome structures together, the outer holders 90 are connected by a sleeve 95 which engages the two adjacent flanges of the holder as shown in FIG. 8.

In FIGS. 9 through 14 we have illustrated the presently preferred form of our structure. In this form of structure we provide a dome structure 110 with a plurality of preformed rigid compound curved arched panel members 112 shaped to form a dome whose base 111 is a circle defined by base plates 111*a* fixed to the bottom or base of each panel member 112. Each of the panel members 112 is connected to the next adjacent panel member by rigid preformed arched riser beams 114. The arched panel members 112 taper in generally triangular form from a wide base 111*a* to a truncated apex 116. A door frame 118 is provided in at least one of each group of panels 112 making up a dome structure according to this invention.

In the presently preferred embodiment of this invention the arched riser beams 114 are made up of a pair of T shaped members, one on each end of each panel member 112. Each of these T members has a center portion or leg 120 and 122 and a top portion 119 and 121. Each top portion 119 and 121 may be provided with a sealant groove 123 adapted to carry a resilient sealing member 123*a*.

Figure 12:
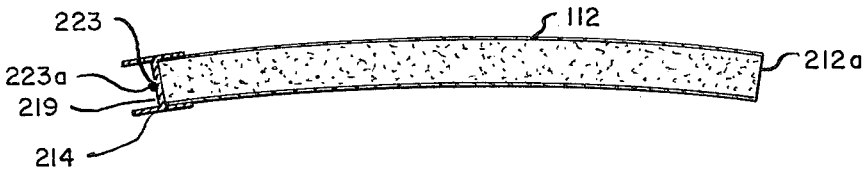
FIG. 12 is a fragmentary section of an integral riser beam and panel structure according to a second embodiment of this invention.

As an alternative structure of riser beam we have shown in FIG. 12 an H shaped riser beam 214 attached to one edge of each panel member and adapted to slidably receive the opposite edge 212*a* of an adjacent panel. Preferably a sealant groove 223 and resilient seal member 223*a* is provided in at least the outer leg portion 219 of each H shaped beam to sealingly engage the panel edge 212*a*.

In the embodiment illustrated in FIGS. 9–14 we also provide a removable stabilizer pole 132 and a stabilizer ring 142 mounted thereon. The stabilizer pole has an internal movable shaft 136 and handle 138 movable in a locking guide slot 137. The movable shaft 136 engages the bottom end of a similar movable shaft 139 within center post 140 of the stabilizer ring. The movable shaft 139 also has a separate handle 141 movable in locking guide slot 143. The shaft 139 carries a ventilator cap 134 which moves vertically with the shaft up and down off its seat 128. Movement of either shaft 139 or 136 will cause this movement of cap 134 because so long as stabilizer pole 132 is in place, shaft 136 engages the lower end of shaft 139.

Each of the compound curved preformed panel members has a locking hook 130 which engages stabilizer ring 142 to hold the ring and panels in fixed integral position. The locking hook 130 may be in the form of a base 130*a* and locking member 130*b* engaging the ring 142 in cooperating slots 131 which surround the ring 142. The locking member 130*b* is fixed in base 130*a* by bolt 130*c*. Other similar or equivalent locking arrangements may, of course, be used. The base 130*a* is provided with a dovetail groove 130*d* which engages a dovetail rail 130*e* on the inside of the panel member.

In the embodiments shown in FIGS. 9–14 wall dividers as illustrated in FIG. 6 may be attached to the stabilizer pole in which event the pole is not removed.

In our preferred embodiment door and window openings are formed in selected panels by Y shaped panel holders 190 and filler panels 191. The filler panels 191 for doorways are preferably formed in three interfitting pieces, a top 200 and sidewalls 201. Each sidewall is cut at each vertical side to a curve corresponding to that of the panel so that it can directly connect two adjacent domes. Each of the top 200 and sidewall members 201 are adapted to fit into panel holders 190.

In the foregoing specification we have set out certain preferred practices and embodiments of this invention. However, it will be understood that this invention may be otherwise embodied within the scope of the following claims.

We claim:

1. A dome structure comprising:
   a. a base;
   b. a stabilizer ring mounted on a removable stabilizer pole forming an apex of a dome spaced from the base;
   c. a plurality of spaced apart rigid pre-arched riser beams fixed at one end to the base and terminating at and attached to the stabilizer ring at the other end at the apex to form a dome shaped frame;
   d. a plurality of preformed and pre-arched panel members between the riser beams and connected to the riser beams, the pre-arched panel members tapering from a wide base to a narrow top at the apex; and
   e. releasable locking means between the stabilizer ring and the riser beams and panel members releasably fastening them together whereby at least a portion of the stabilizer pole may be removed.

2. The dome structure as recited in claim 1 wherein a pair of spaced rings carrying hinges surround the stabilizer pole with a partition panel connected to the hinges.

3. The dome structure as recited in claim 1 wherein the arched panel members comprise urethane foam sandwiched between aluminum sheets.

4. A dome structure comprising:
   a. a base;
   b. a stabilizer pole having:

1. a ventilator cap at the top portion of the pole and forming an apex portion of the dome;
2. an activator rod coupled to the ventilator cap and extending through the pole;
3. a handle means attached to the activator rod for raising and lowering the ventilator cap;
4. a horizontal ring coupled to the top portion; and
5. a pair of spaced rings carrying hinges mounted on the pole;

c. a plurality of spaced apart rigid preformed and pre-arched riser beams having one end fixed to the base and the opposite end terminating at the apex on the horizontal ring which comprise a pair of arched T members each having a top portion and a center portion, the two top portions face each other and the center portions abut each other so as to form an H section, said riser beams and ring forming a frame; and d. a plurality of preformed and pre-arched panel members tapering from a wide base to a narrow top at the apex, each adjacent panel member engaging an open channel of the H section of the riser beams thereby joining two adjacent panels with a riser beam, each panel member having:
1. removable locking means coupled to the narrow top and fixedly engaging the horizontal ring at the top of the stabilizer whereby at least a portion of the stabilizer pole may be removed; and
2. a T member connected to the wide base with a center portion of the T abutting an inside face of the panel member and a base of the T abutting a bottom face of the panel member.

5. The dome structure as recited in claim 4 wherein the arched panel members comprise urethane foam sandwiched between aluminum sheets.

* * * * *